US007377089B2

(12) United States Patent
Rapparini

(10) Patent No.: US 7,377,089 B2
(45) Date of Patent: May 27, 2008

(54) FILTER PAPER POD PACKAGING MACHINE

(75) Inventor: Gino Rapparini, Bologna (IT)

(73) Assignee: Aroma System SRL, Bologna (IT)

( * ) Notice: Subject to any disclaimer, the term of this patent is extended or adjusted under 35 U.S.C. 154(b) by 0 days.

(21) Appl. No.: 10/575,106

(22) PCT Filed: Nov. 3, 2004

(86) PCT No.: PCT/IB2004/003589

§ 371 (c)(1),
(2), (4) Date: Apr. 10, 2006

(87) PCT Pub. No.: WO2005/047111

PCT Pub. Date: May 26, 2005

(65) Prior Publication Data

US 2007/0017825 A1 Jan. 25, 2007

(30) Foreign Application Priority Data

Nov. 12, 2003 (IT) ..... BO2003A0666

(51) Int. Cl.
*B65B 29/02* (2006.01)
*B65B 9/04* (2006.01)
*B65B 63/02* (2006.01)

(52) U.S. Cl. ..... 53/526; 53/553; 53/560

(58) Field of Classification Search ..... 53/560, 53/526, 528, 553, 559
See application file for complete search history.

(56) References Cited

U.S. PATENT DOCUMENTS 1,402,293 A * 1/1922 Heist ..... 156/145
1,895,899 A * 1/1933 Schaub ..... 53/553
2,497,212 A * 2/1950 Donofrio ..... 53/443
2,828,590 A * 4/1958 Swartz et al. ..... 53/526
2,949,713 A * 8/1960 Vogt ..... 53/559
3,092,942 A * 6/1963 Chasman ..... 53/560
4,555,894 A * 12/1985 Illy ..... 53/528
4,567,714 A * 2/1986 Chasman ..... 53/438
4,571,924 A * 2/1986 Bahrani ..... 53/453
4,747,250 A * 5/1988 Rossi ..... 53/528
4,751,805 A * 6/1988 Walter ..... 53/168
5,012,629 A 5/1991 Rehman et al.
5,459,980 A * 10/1995 Kenney et al. ..... 53/553
6,591,585 B2 * 7/2003 Stolz ..... 53/454
6,662,531 B1 * 12/2003 Schwab et al. ..... 53/453

FOREIGN PATENT DOCUMENTS

EP 0 432 126 6/1991
EP 0 943 544 9/1999

* cited by examiner

*Primary Examiner*—Stephen F. Gerrity
(74) *Attorney, Agent, or Firm*—Oblon, Spivak, McClelland, Maier & Neustadt, P.C.

(57) ABSTRACT

A filter paper pod packaging machine is disclosed which includes a polygonal prismatic wheel with a horizontal axis for intermittently rotating the wheel, each flat face of the prismatic wheel directly incorporating at least one recess matching size and shape of pods to be produced, wherein a first web of filter paper, fed from a spool and overlaid by a second web of filter paper fed from another spool, is wrapped around the flat faces of the polygonal prismatic wheel, and wherein a series of cuts are made by a cutting device in the first web of filter paper in appropriate positions around a central zone corresponding to the at least one recess impressed in the prismatic wheel.

9 Claims, 24 Drawing Sheets

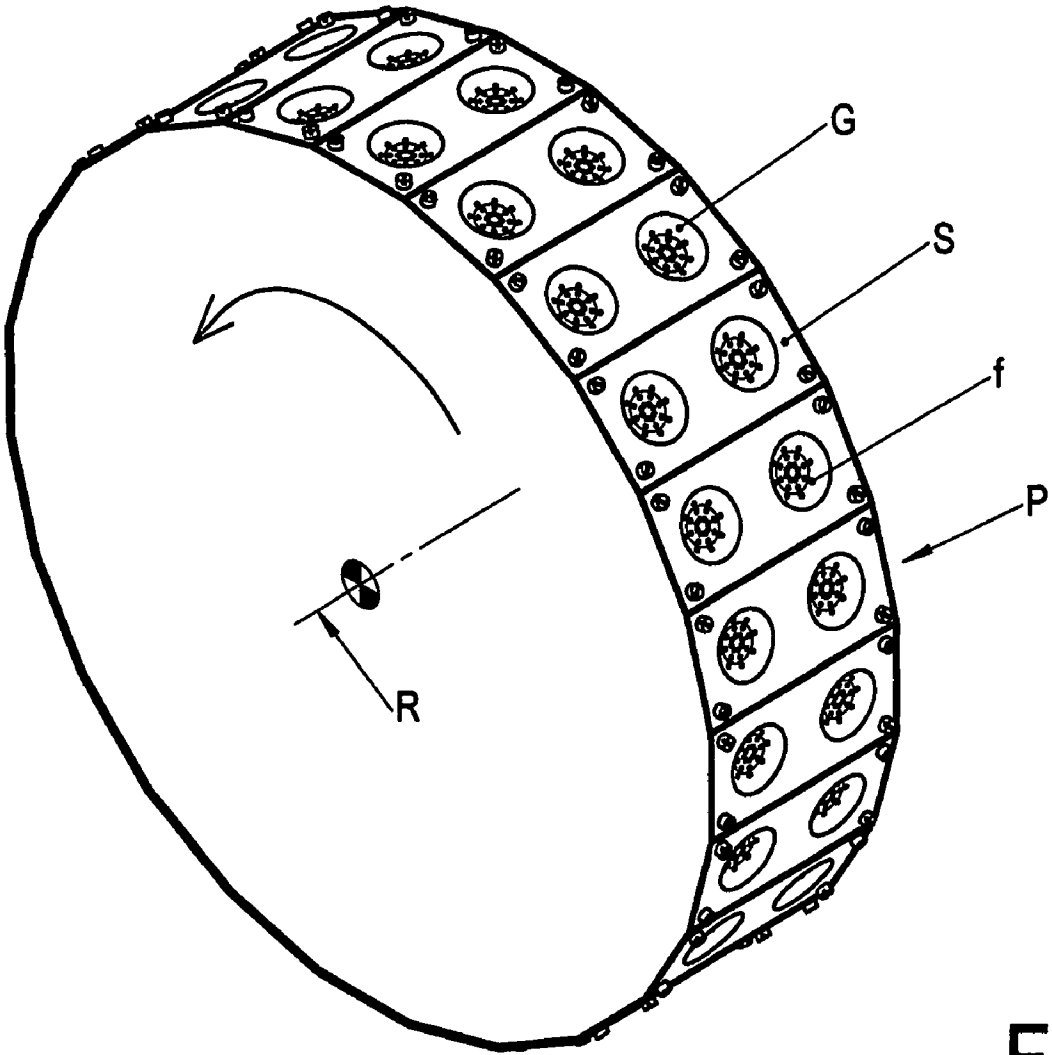
FIG. 1 BIS

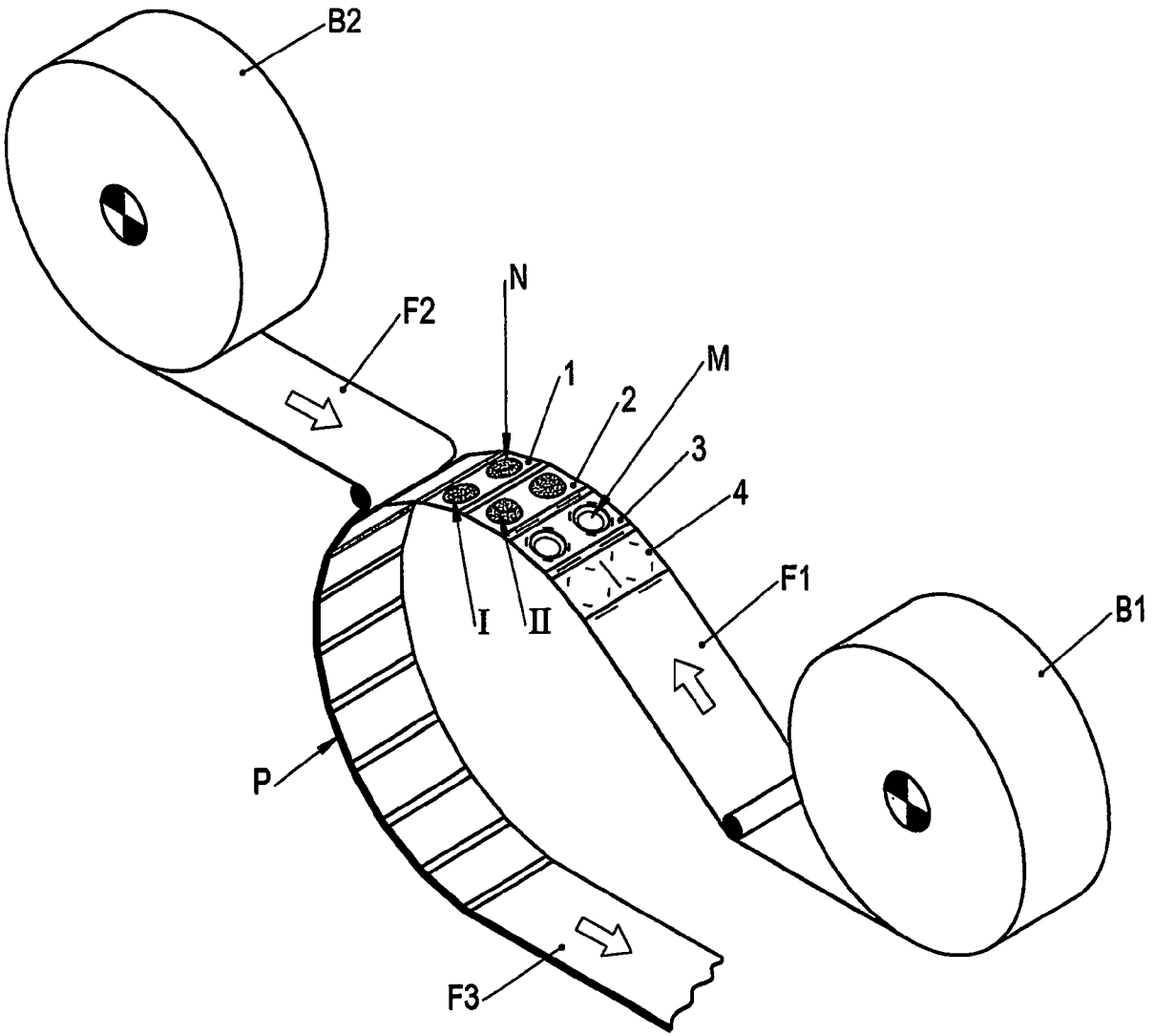
FIG. 7 BIS

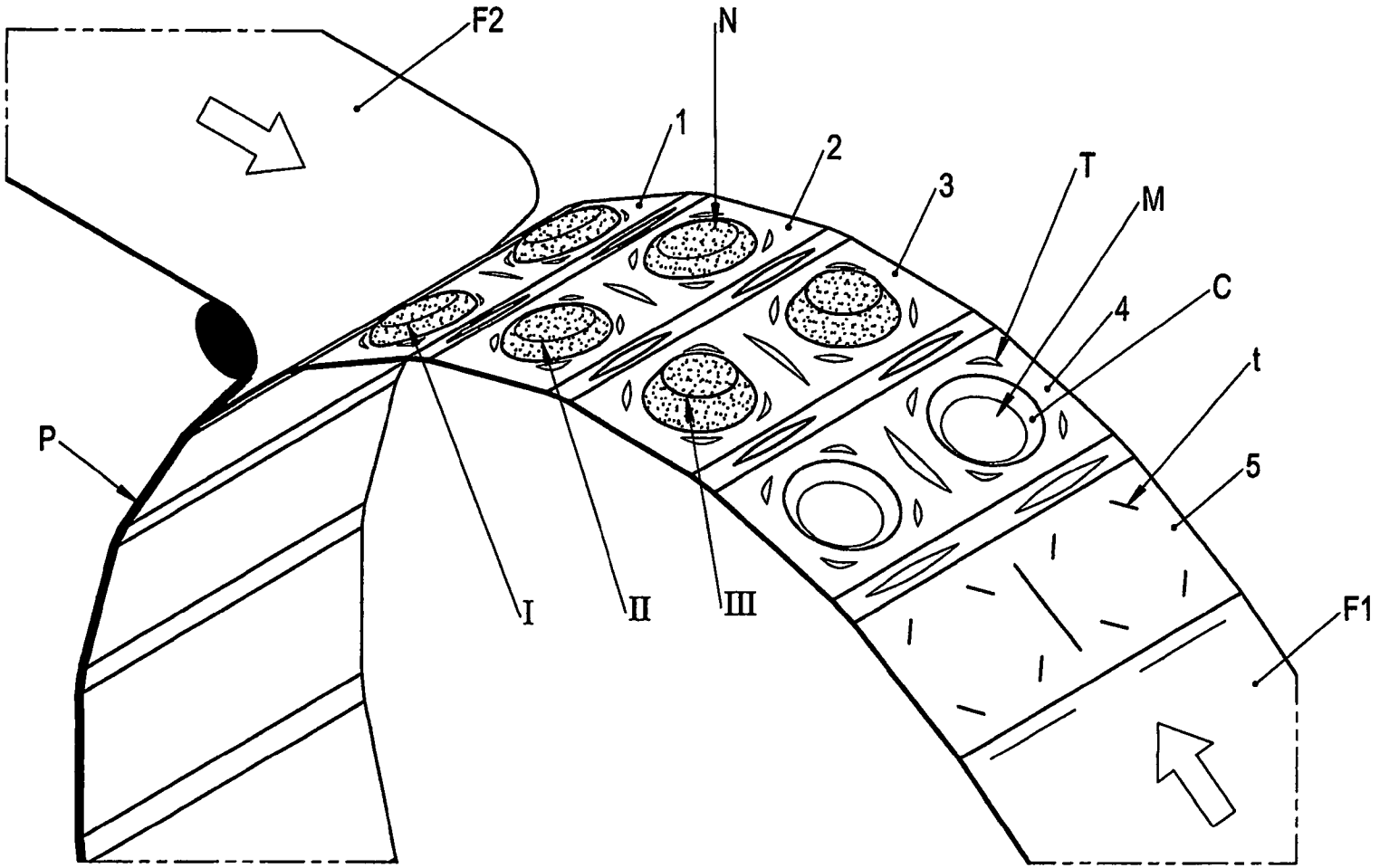
FIG. 9 BIS

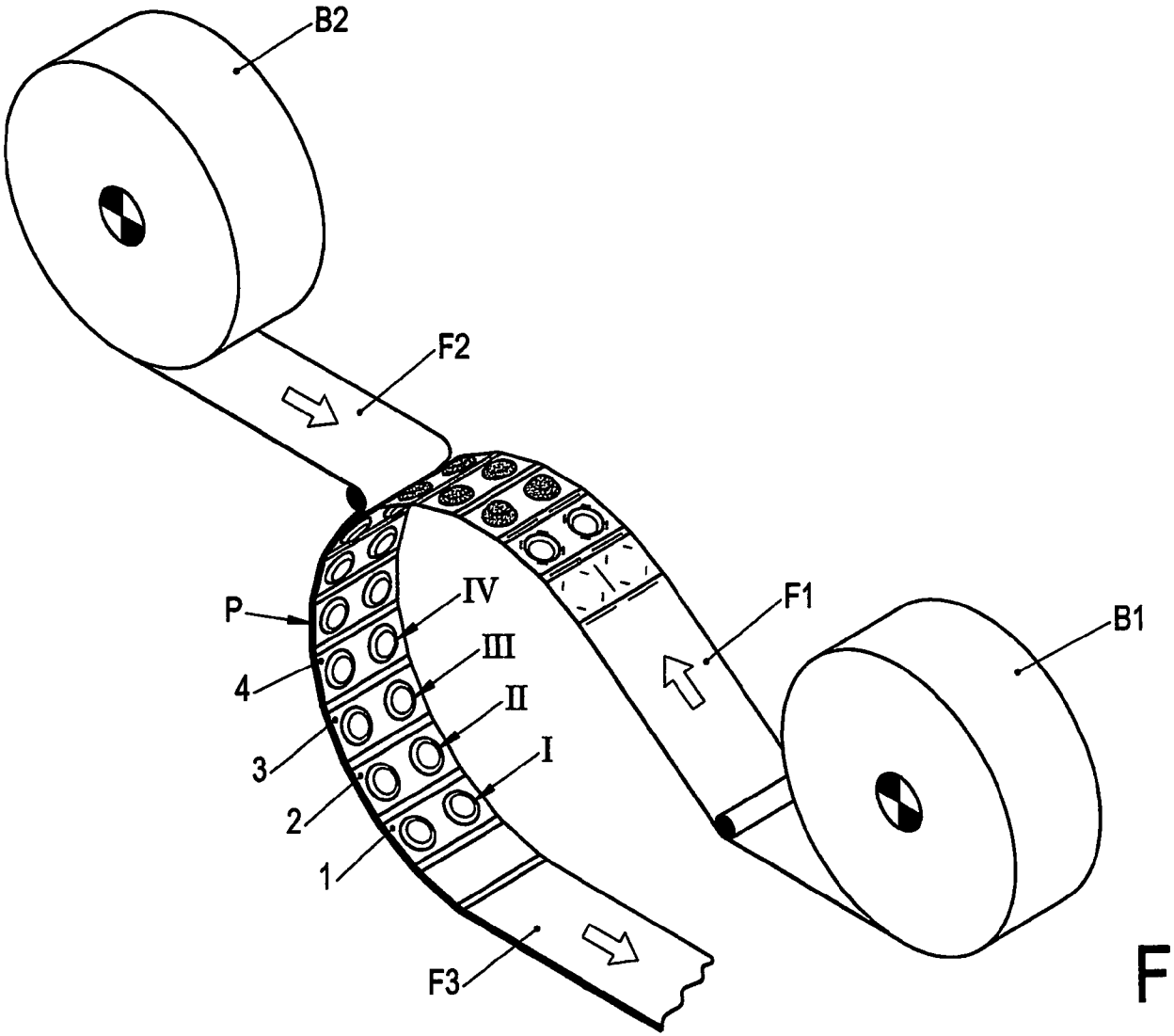
FIG. 10 BIS

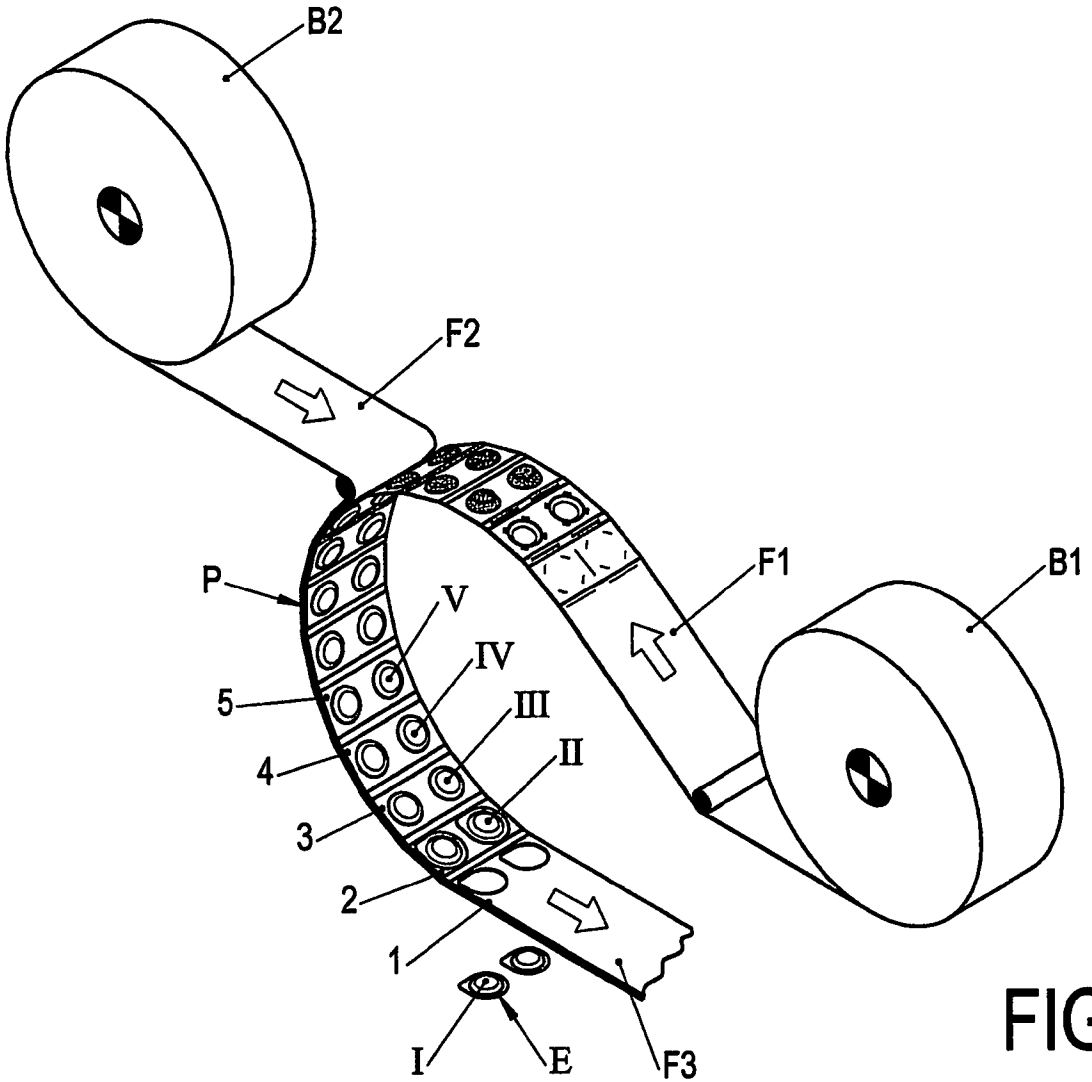
FIG. 12 BIS

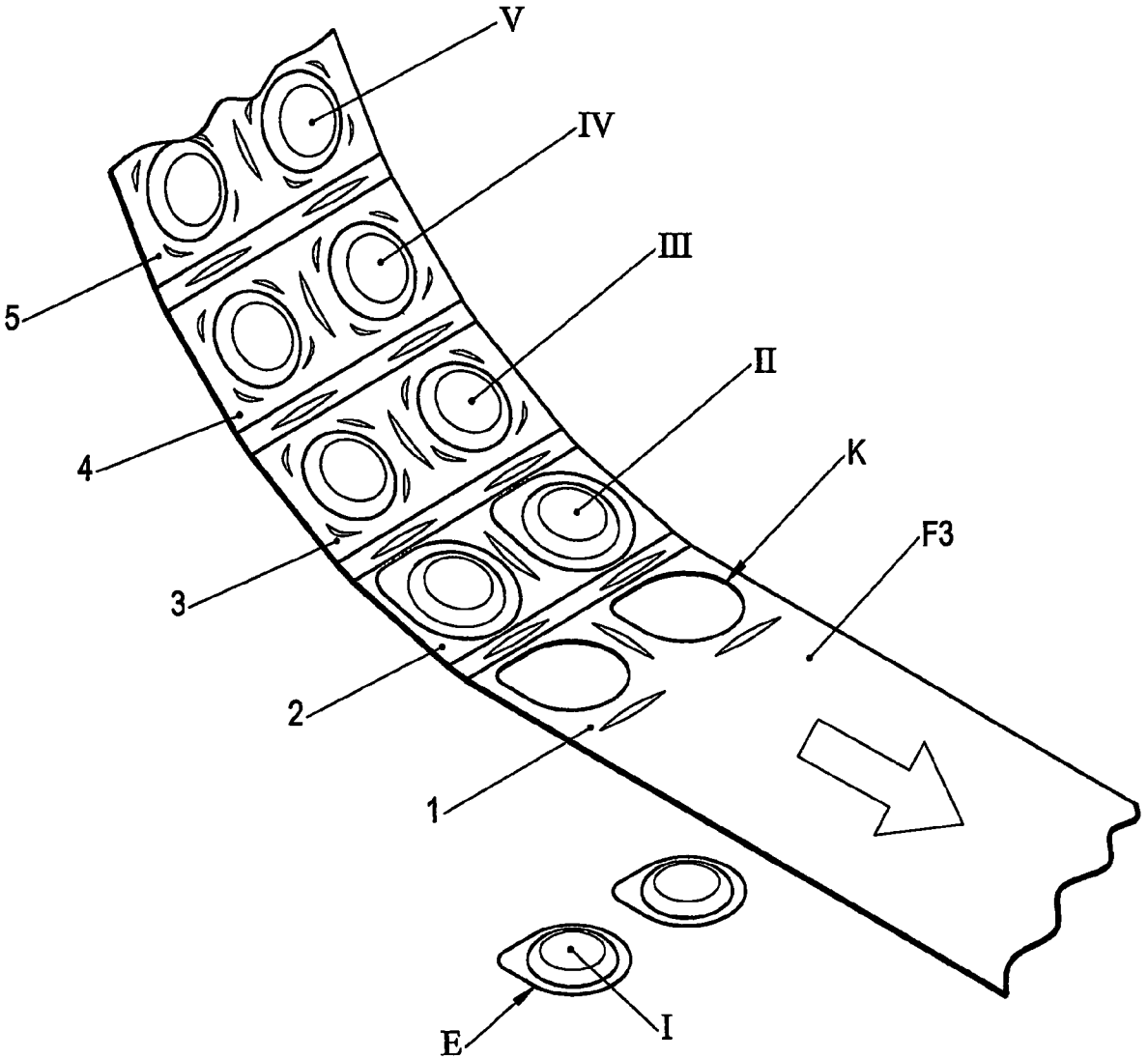
FIG. 13 BIS

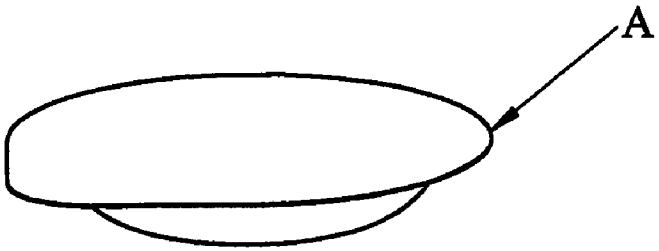
FIG. 14
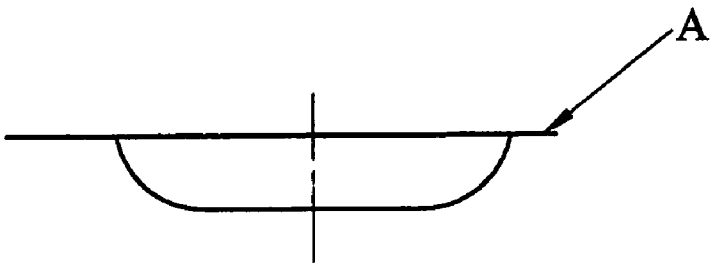
FIG. 15
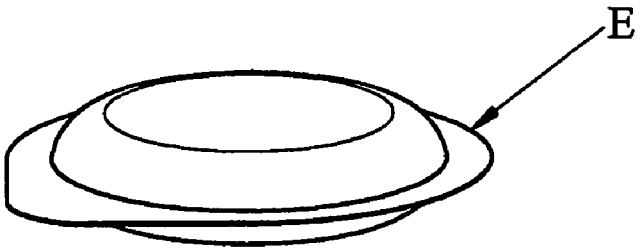
FIG. 14 BIS
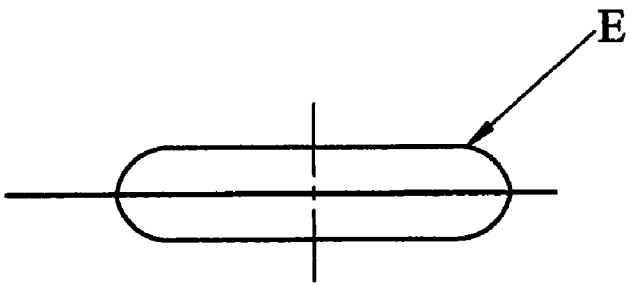
FIG. 15 BIS FIG. 19 BIS
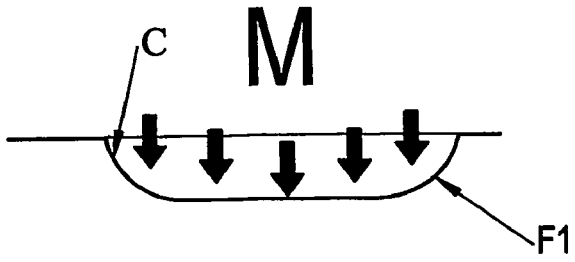
FIG. 20 BIS
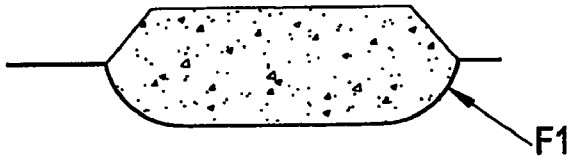
FIG. 21 BIS
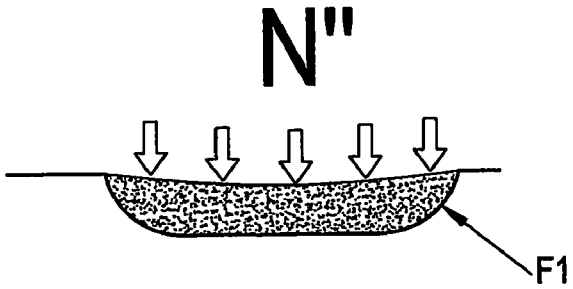
FIG. 22 BIS
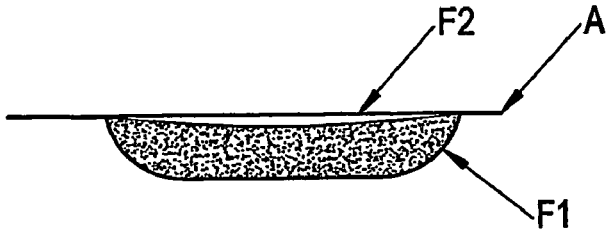

FIG. 19 TER
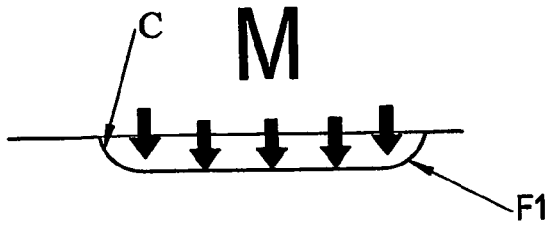
FIG. 20 TER
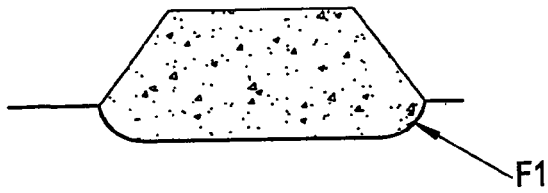
FIG. 21 TER
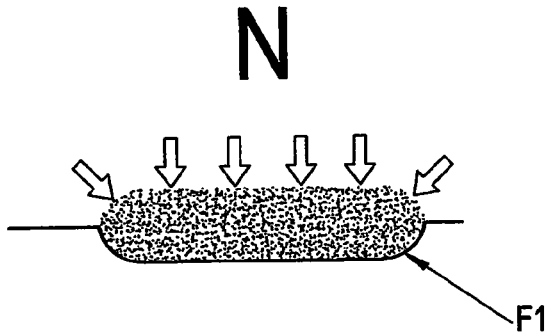
FIG. 22 TER
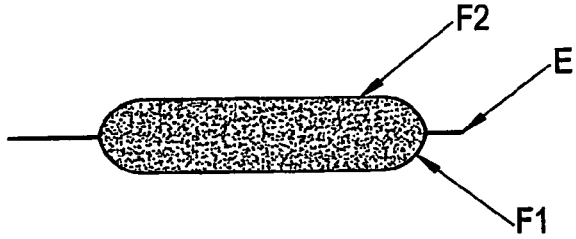

FILTER PAPER POD PACKAGING MACHINE

FIELD OF THE ART

The present invention refers to the engineering of machines for packaging products in filter paper pods. International reference classification B65b.

STATE OF THE ART

The use of filter paper pods to package individual portions of ground products is well known in the art. Pods containing ground coffee of varying particle size are widely used. All the machines known up to now pose specific problems, especially as regards control over the degree of compacting. Moreover, the presently available machines do not perform reliably and are incapable of maintaining the high output rates demanded by the market. The problem to be solved, therefore, is to produce economical and reliable pods at a fast rate and with constant precision in terms both of the product weight per packaged dose and its degree of compactness, also where the particle size is not homogeneous.

The pod packaging machine as envisaged in the present invention solves all the above-described problems and is highly economical both to manufacture and to operate in an industrial setting.

Besides occupying a minimal surface area, the machine of the present invention has a highly compact en bloc structure.

DESCRIPTION

The invention will now be explained referring to the appended drawings, which serve solely illustrative purposes and in no way limit the scope of the invention itself.

FIG. 1 is a schematic axonometric representation of a carousel with an intermittently rotating horizontal axis (R) and a circumference shaped as a polygonal prism (P) whose flat faces (L) have recesses which are directly impressed in the surface (G) and geometrically match the shape and size of the pods that will be made. It is possible to note the presence of twin recesses (G) on each face of the prism.

FIG. 1 BIS is a schematic axonometric representation of a carousel with an intermittently rotating horizontal axis (R) and a circumference shaped as a polygonal prism (P) whose flat faces (L) are equipped with interchangeable dies (S) featuring twin recesses (G).

FIG. 2 schematically represents the routing of two webs of filter paper (F1, F2), fed out from their respective spools (B1, B2) and wrapped, one overlying the other, around the flat faces of the polygonal carousel (P).

Figure 1:
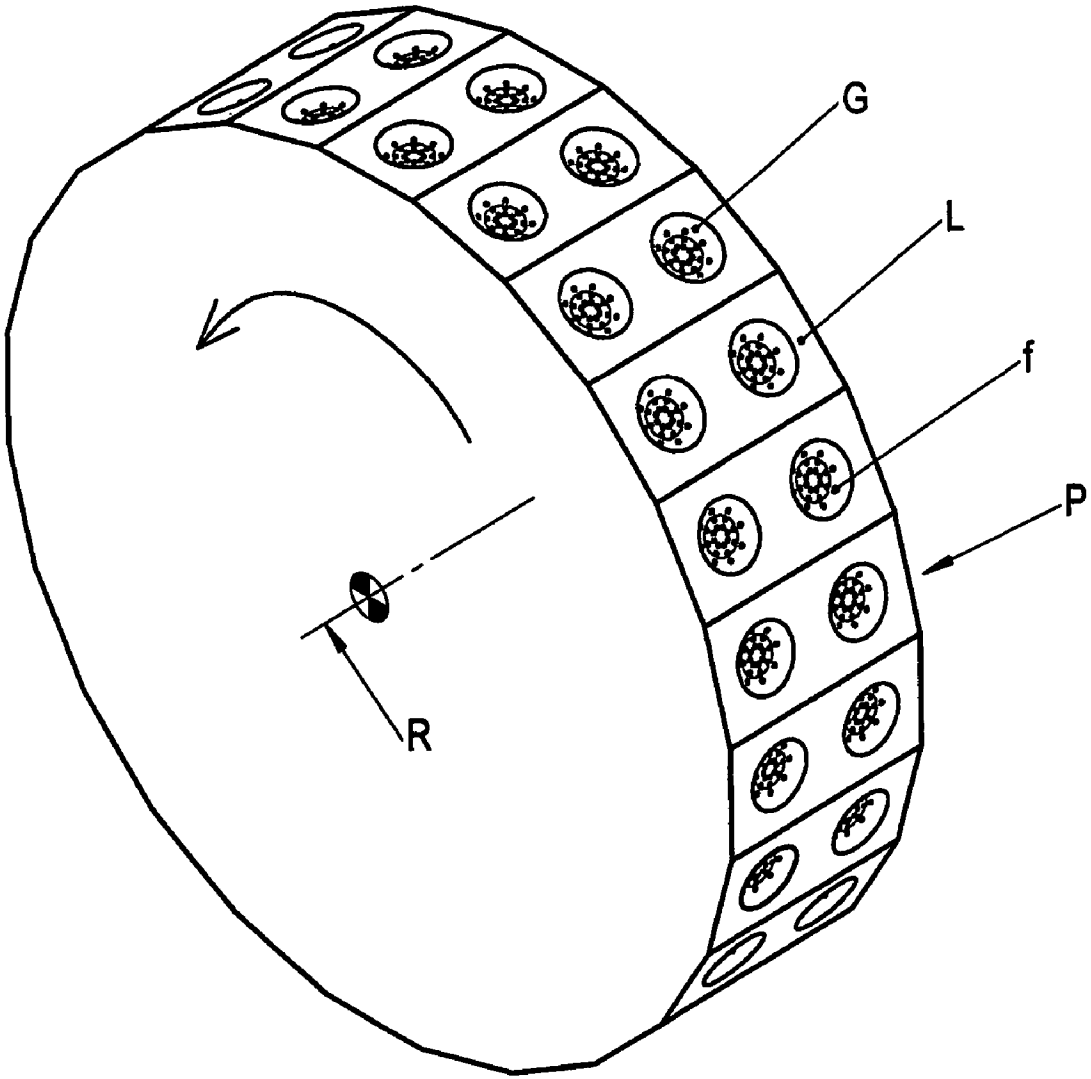
Figure 2:
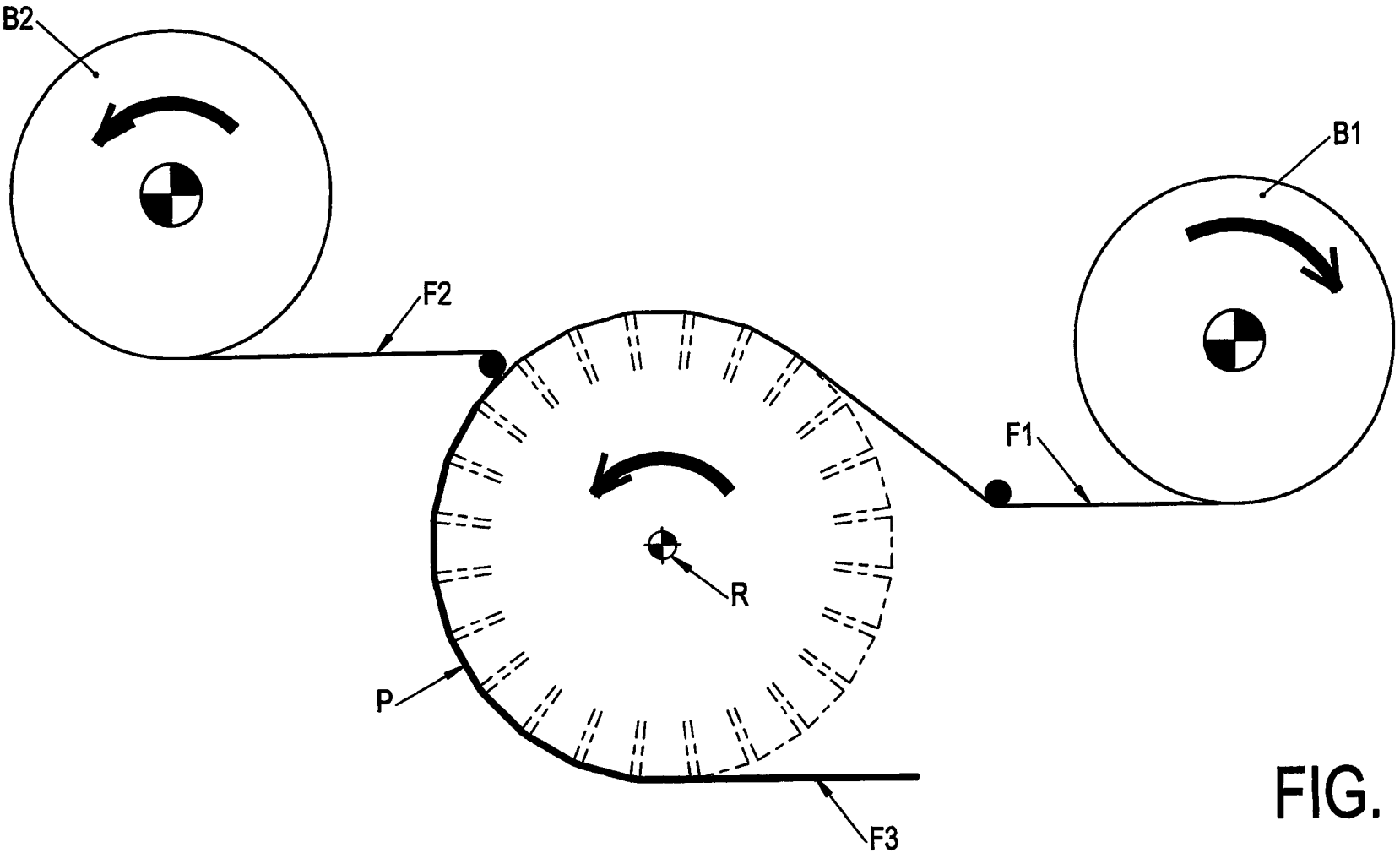
Figure 3:
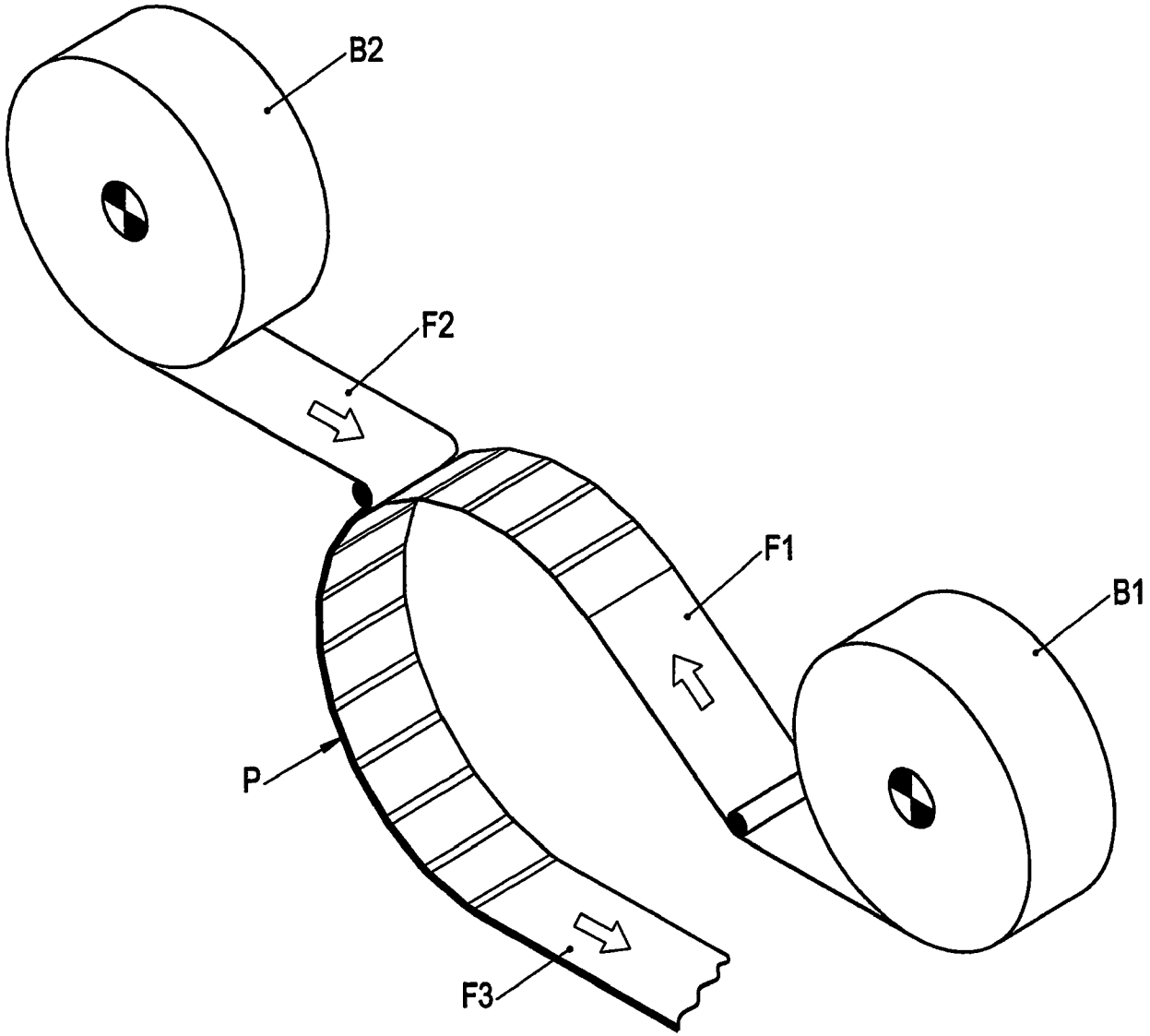
FIG. 3 is an axonometric diagram showing the routing of the filter paper on the infeed (F1, F2) and outfeed (F3) side.
Figure 4:
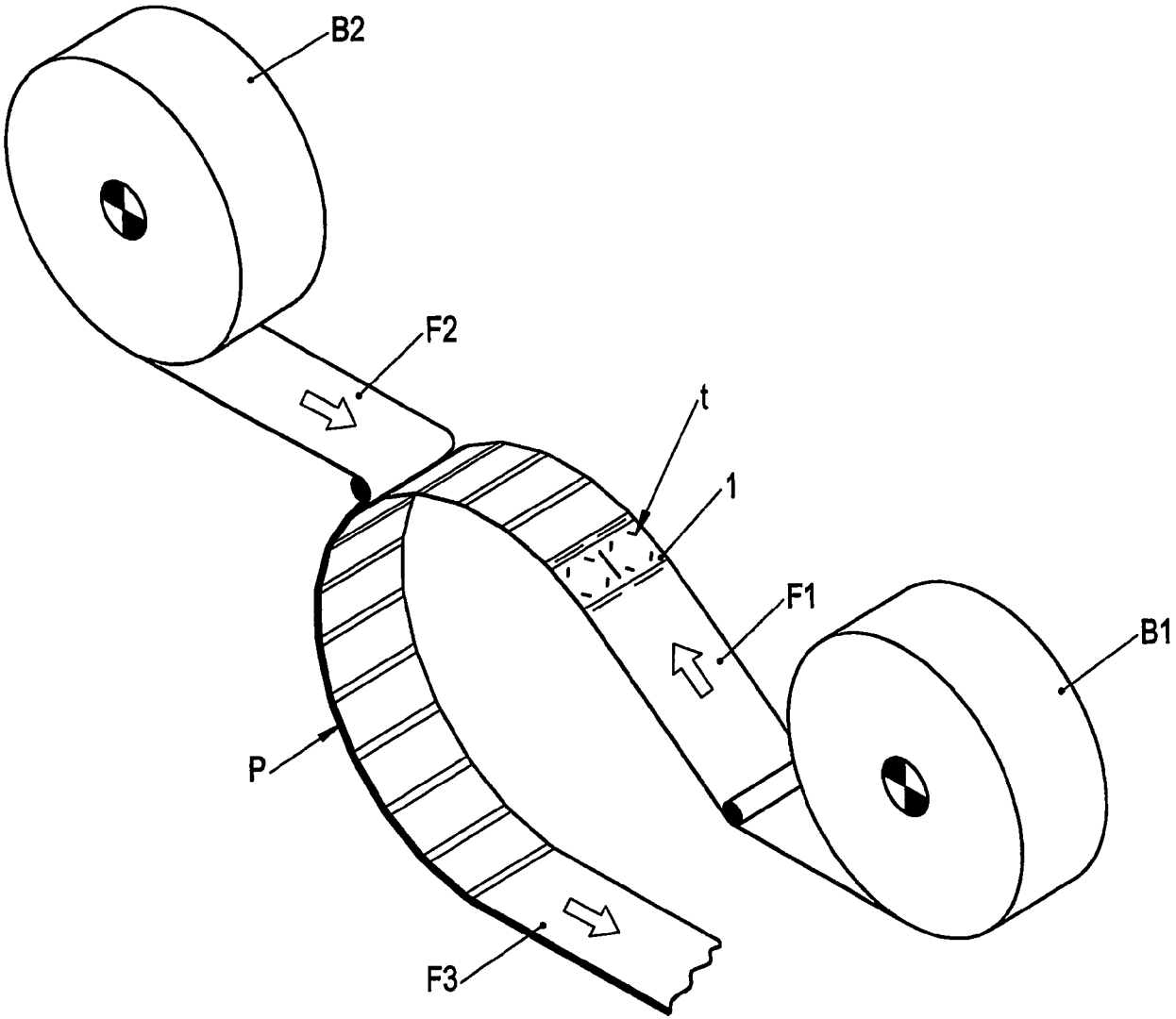
FIG. 4 illustrates the execution, using means known in the art and hence not shown, of a first series of cuts (t) on the flat section (1) of the filter paper (F1).
Figure 5:
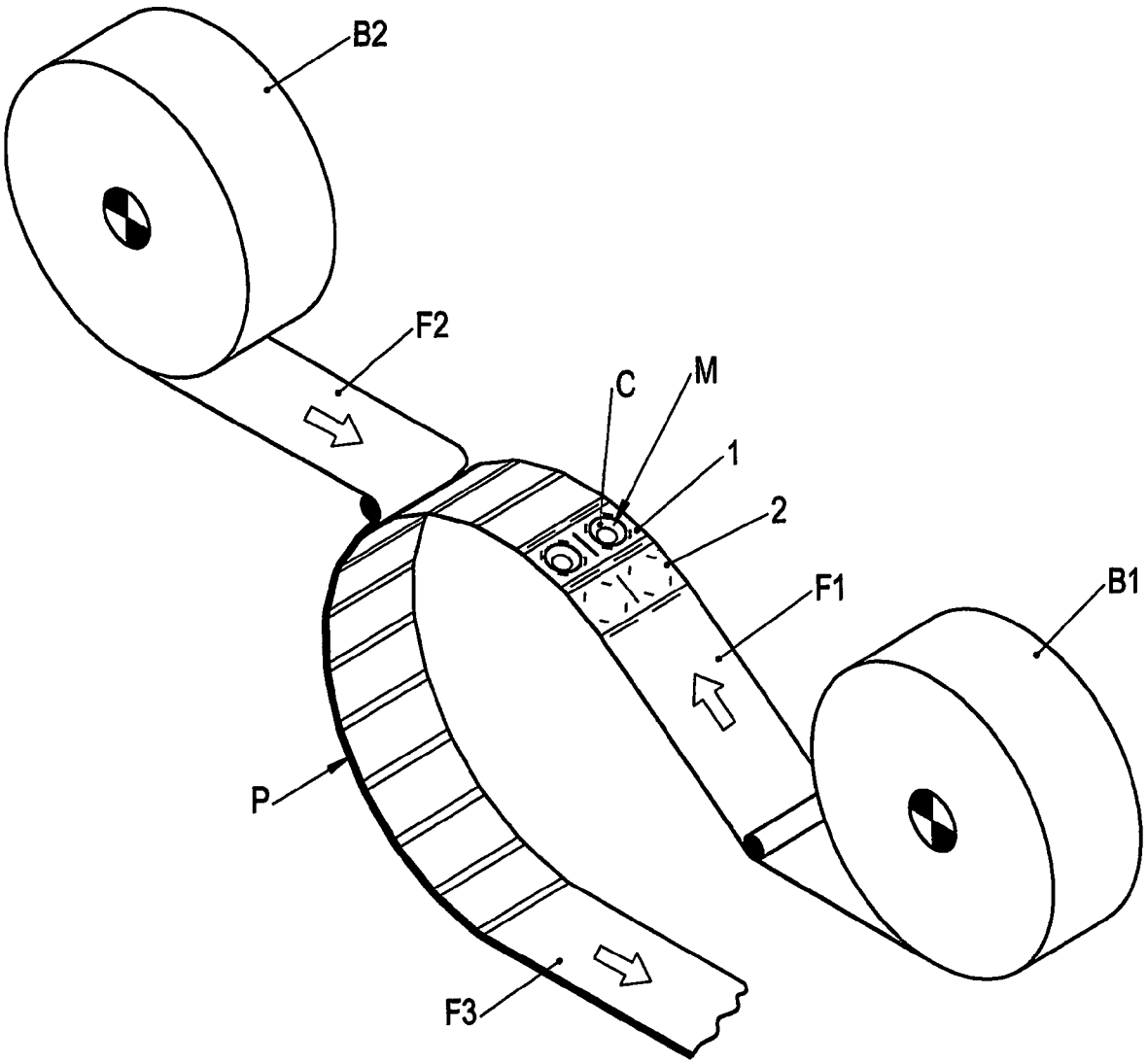
FIG. 5 illustrates the execution of a second series of cuts in the second flat section (2) and a depression (G) in the central part of the flat section (1) obtained by means of a forming punch indicated by the arrow (M).
Figure 6:
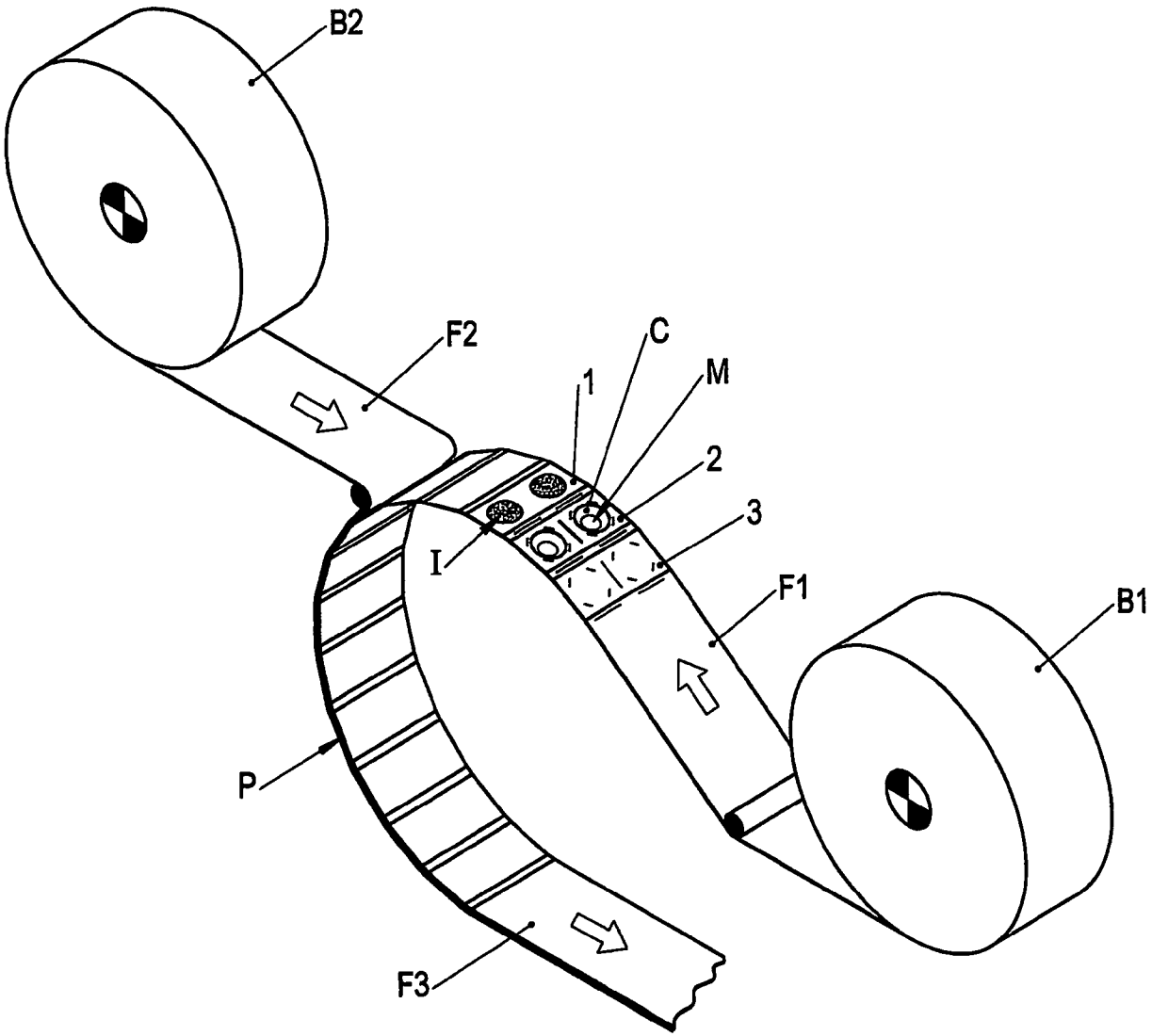
FIG. 6 illustrates the feeding of a predetermined dose (I) of product into the zone of the respective depression (C).
Figure 7:
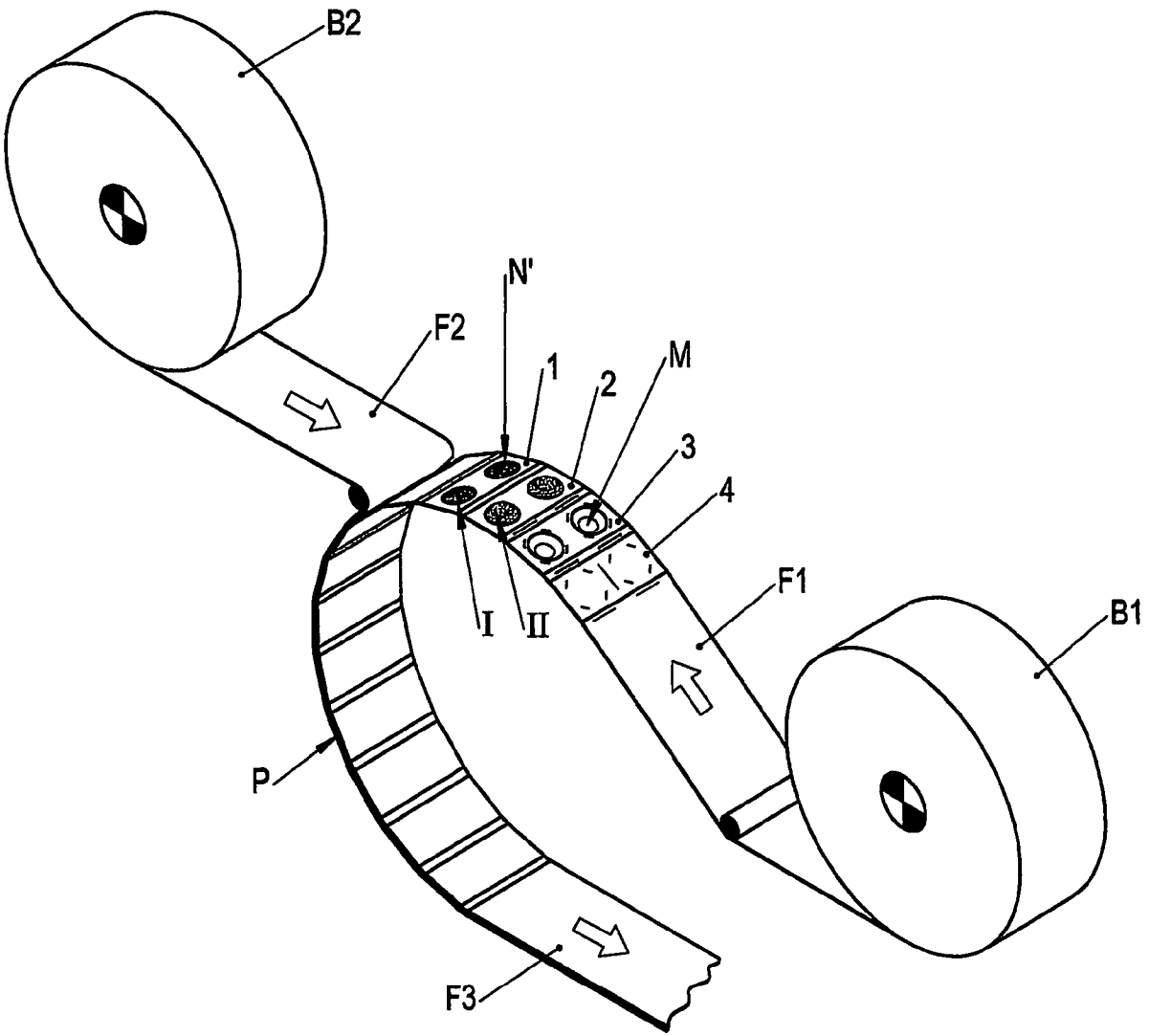
FIG. 7 illustrates the operation of a flat tamping punch (N') for forming asymmetrical pods.

FIG. 7 BIS, similar to FIG. 7, illustrates the operation of a concave tamping punch (N) for forming symmetrical pods.

Figure 8:
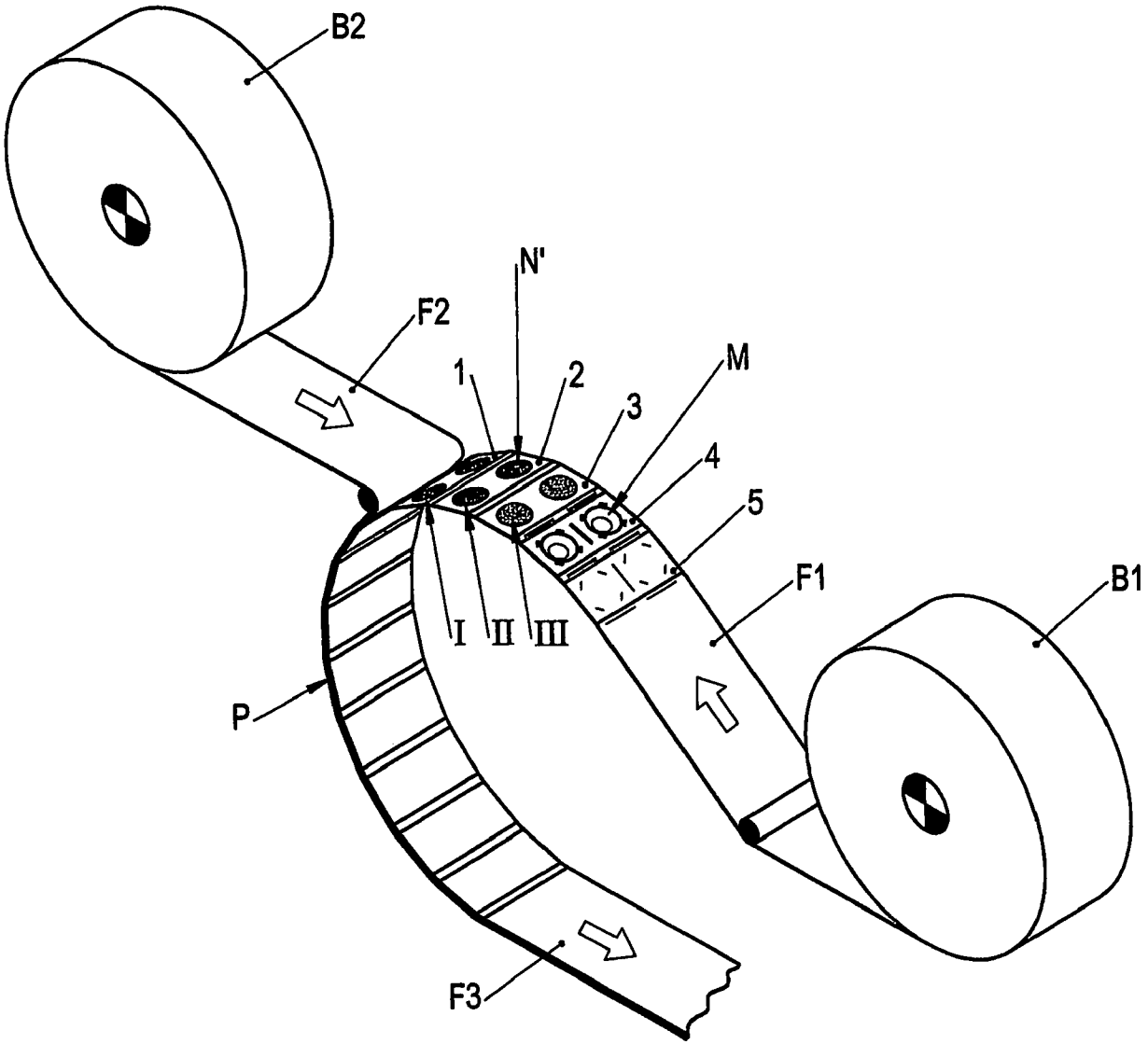

FIG. 8 illustrates the arrival of the filter paper (F2), which is applied over the compacted dose.

Figure 9:
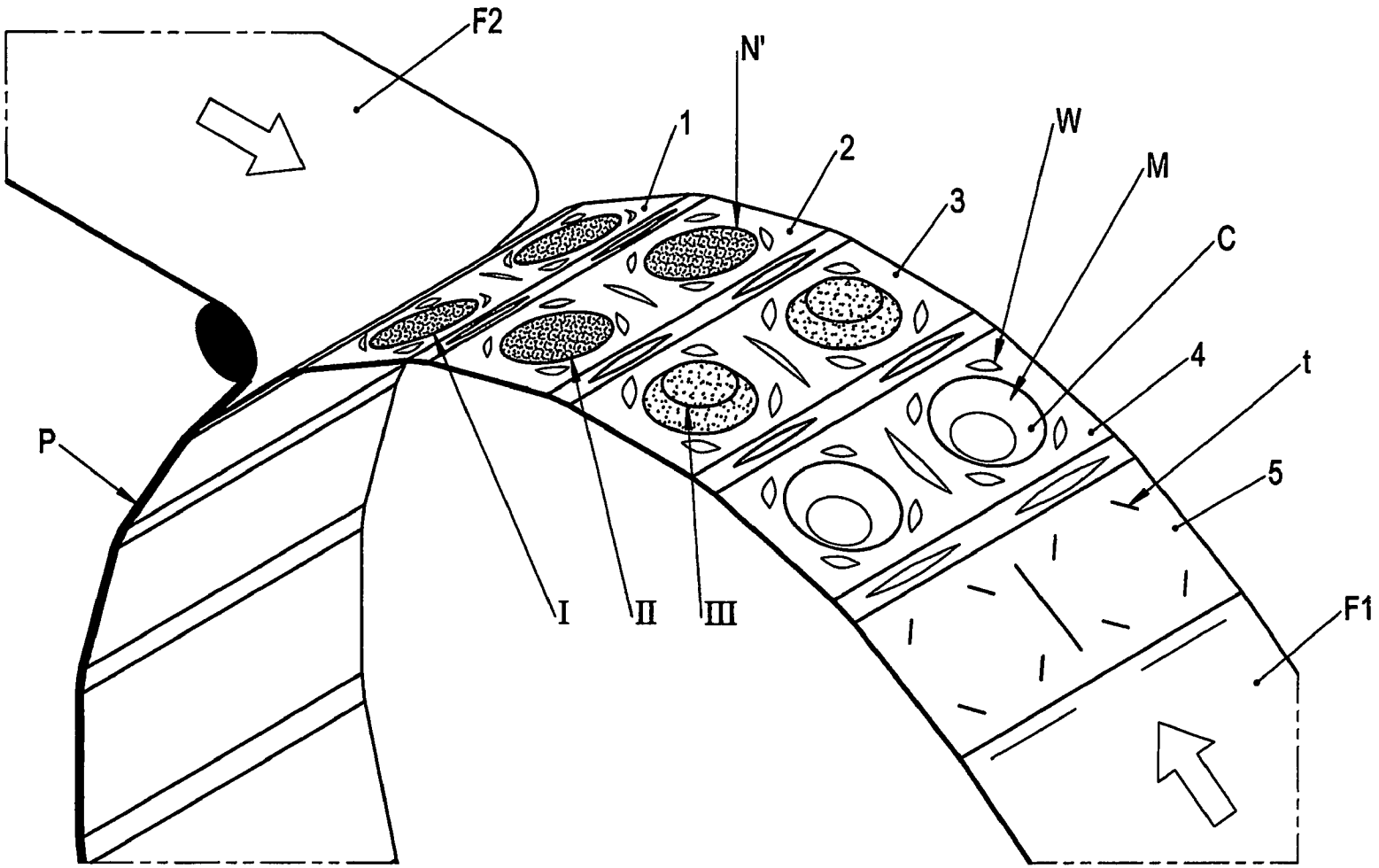

FIG. 9 shows, on a duly enlarged scale, the greater flaring (W) of the cuts (t) during the action of the forming punch (M), which serves to obtain a deeper depression (C). It may be noted that the action of the flat tamping punch (N') has compacted the entire dose flush with the face of the prism so as to create an asymmetrical pod. FIG. 9 BIS, similar to FIG. 9, shows, on a duly enlarged scale, the lesser flaring (I) of the cuts (t) during the action of a forming punch (M) serving to obtain a shallower depression (C). It may be noted that the action of the concave tamping punch (N) has compacted the coffee so as to create a symmetrical pod.

Figure 10:
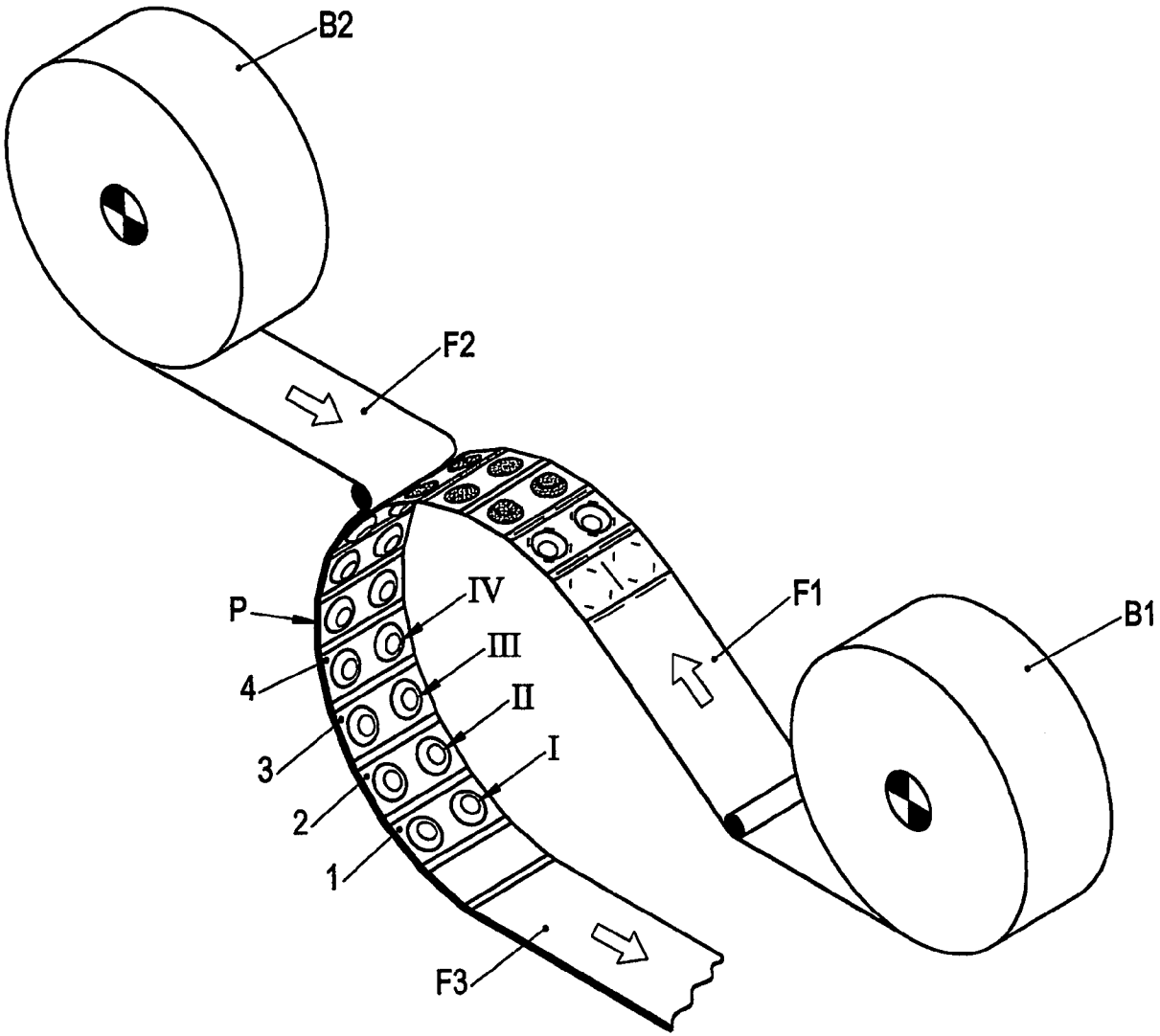

FIG. 10 illustrates the configuration of the operating sequence for asymmetrical compacted pods.

FIG. 10 BIS, similar to FIG. 10 and refers to the operating sequence for producing symmetrical compacted pods.

Figure 11:
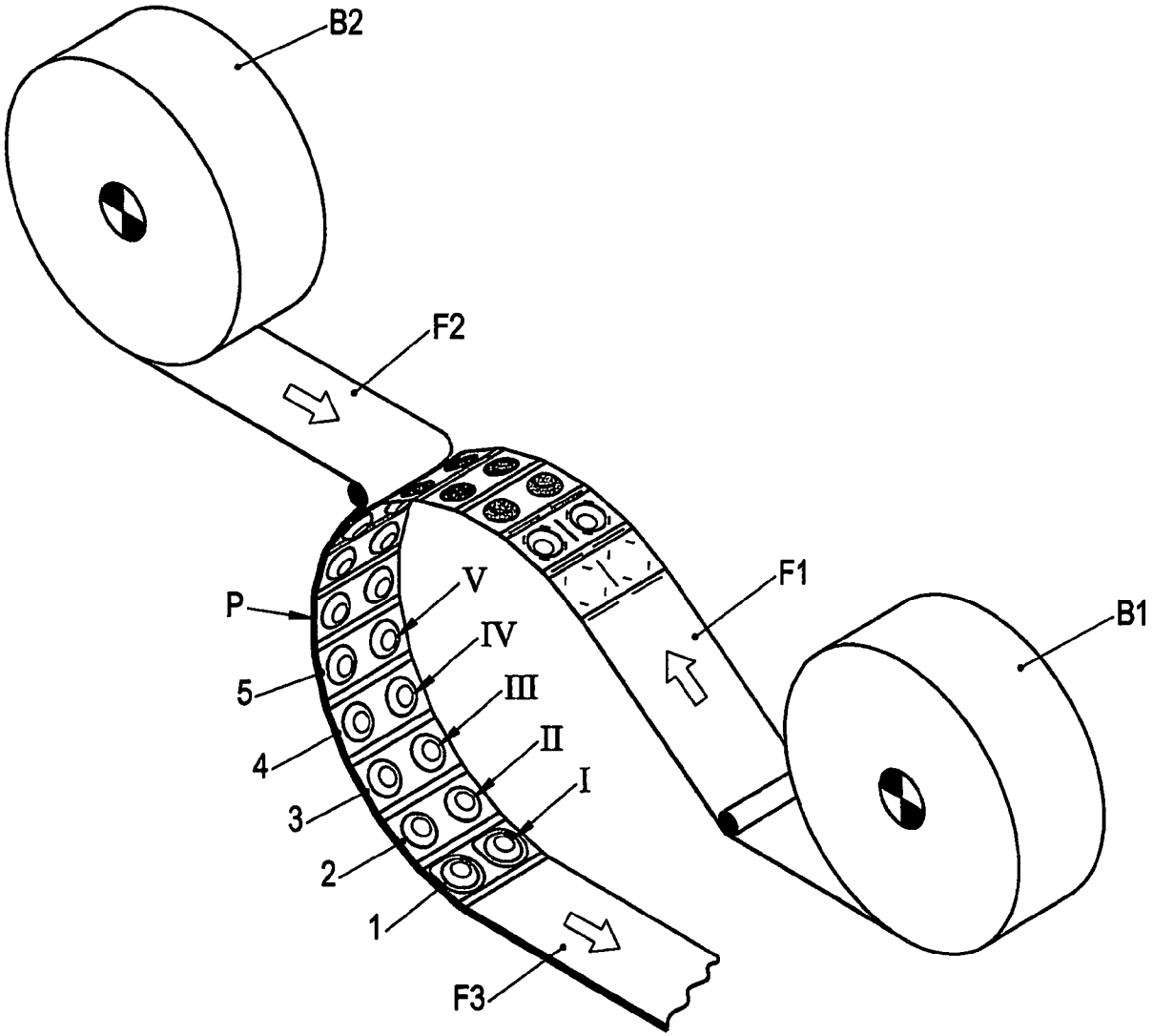

FIG. 11 illustrates the operation of die cutting around the edge of the packaged pods.

Figure 12:
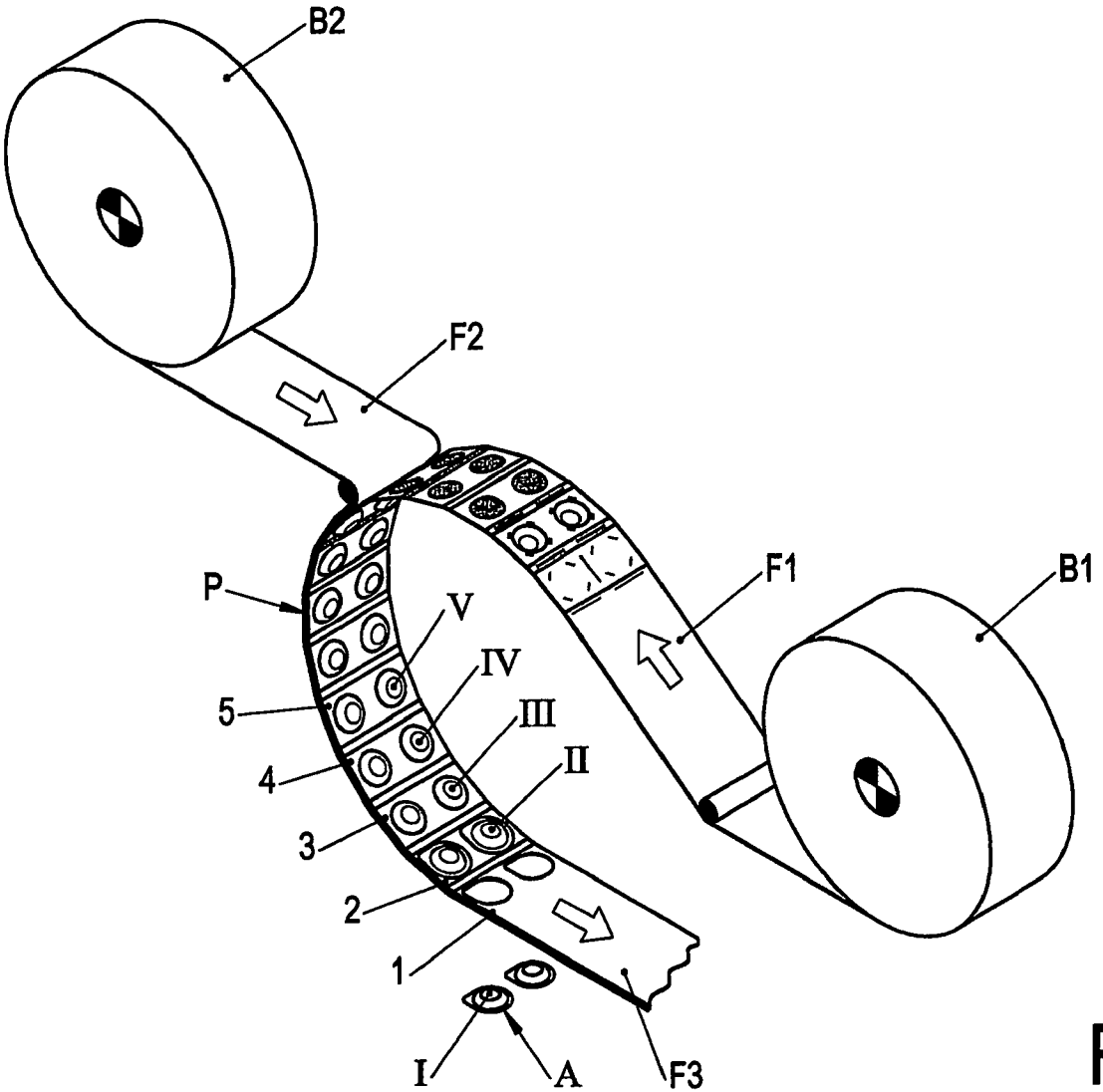

FIG. 12 illustrates the separation of the asymmetrical pods (A) from the double layer of filter paper (F3).

FIG. 12 BIS illustrates the separation of symmetrical pods (E).

Figure 13:
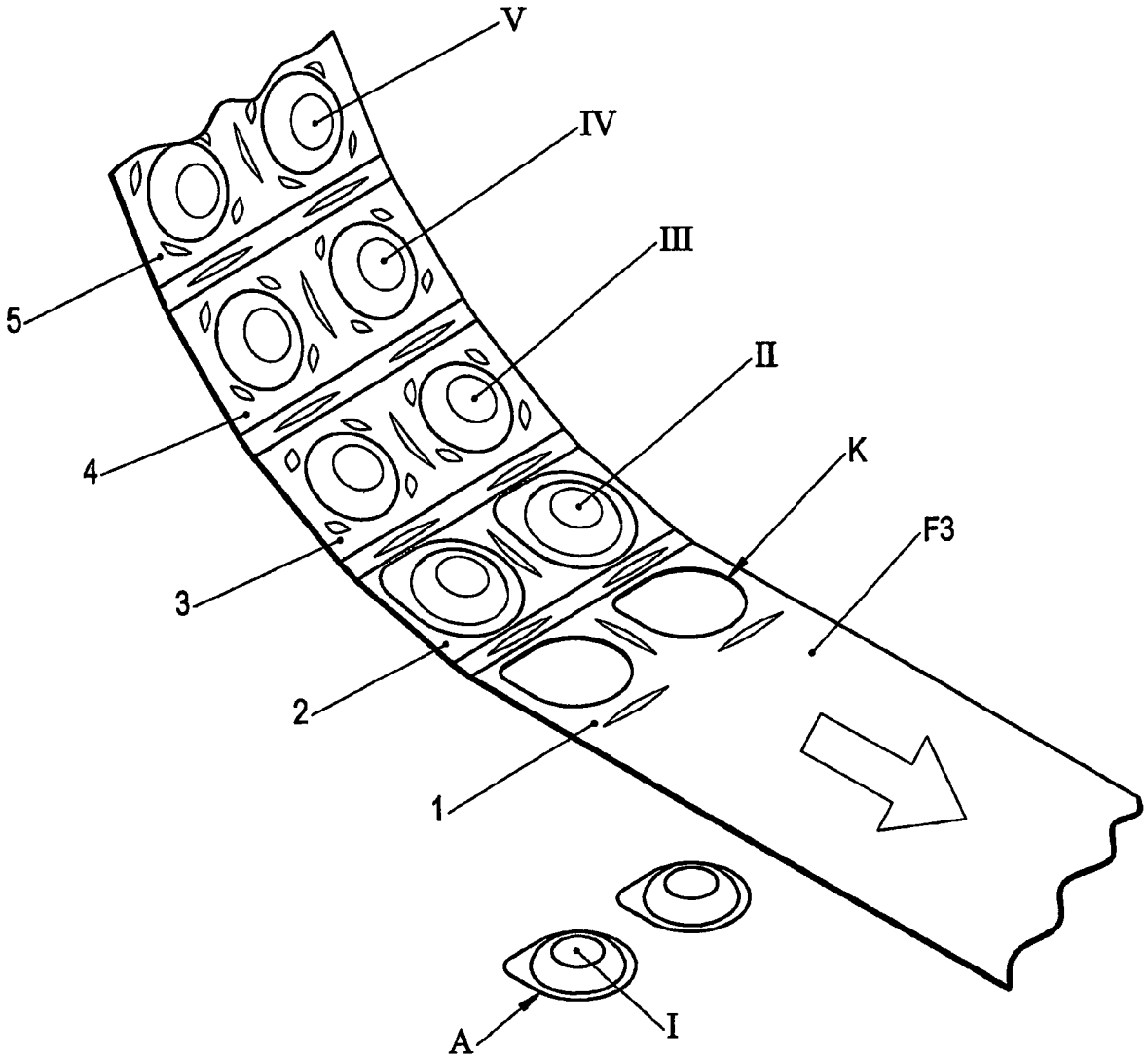

FIG. 13 illustrates, on a duly enlarged scale, the separation of a type (A) asymmetrical flat-topped compacted pod.

FIG. 13 BIS illustrates, on a duly enlarged scale, the separation of a type (E) symmetrical compacted pod.

FIG. 14 is an axonometric view of a type (A) asymmetrical flat-topped compacted pod.

FIG. 14 BIS is an axonometric view of a symmetrical compacted pod (E).

FIG. 15 is a front view of an asymmetrical flat-topped compacted pod (A).

FIG. 15 BIS is a front view of a symmetrical compacted pod (E).

Figure 16:
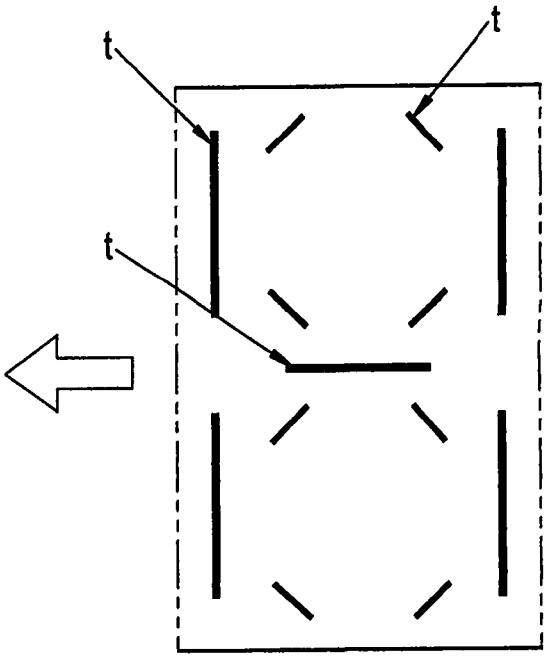

FIG. 16 shows the distribution, as seen from above, of a series of cuts (t) around the central zone of the flat face (L) of the prism (P).

Figure 17:
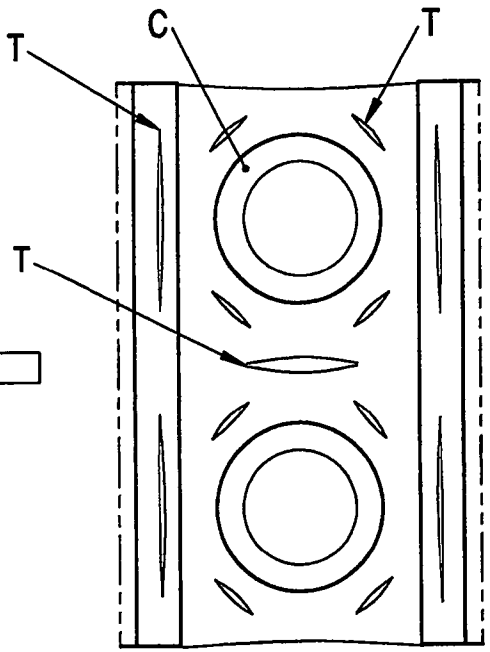

FIG. 17 shows how the cuts are flared (I) to make symmetrical pods.

Figure 18:
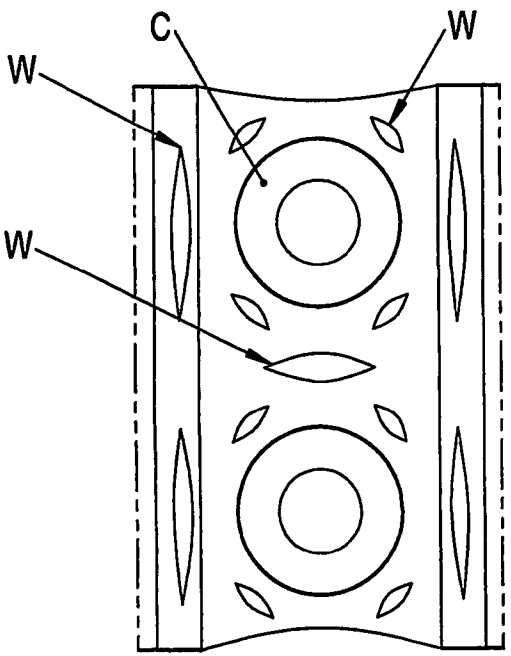

FIG. 18 shows how the cuts are flared to a greater degree (W) to make an asymmetrical flat-topped compacted pod, given the greater depth of the depression formed.

Figure 19:
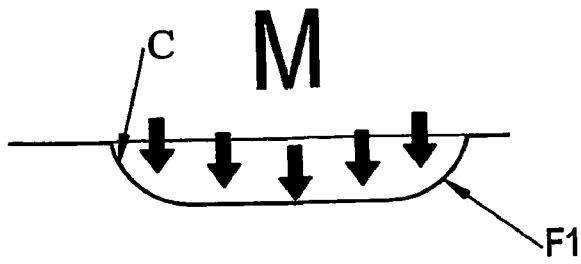

FIG. 19 schematically represents, in a cross-section view, the action of a forming punch (M), which is such as to lend the filter paper (F1) the deeper shape (C) required for the bottom half of a flat-topped pod.

Figure 20:
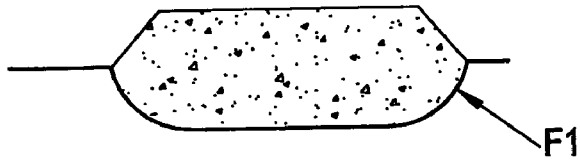

FIG. 20 illustrates a dose of product being fed for packaging in a type (A) asymmetrical flat-topped pod.

Figure 21:
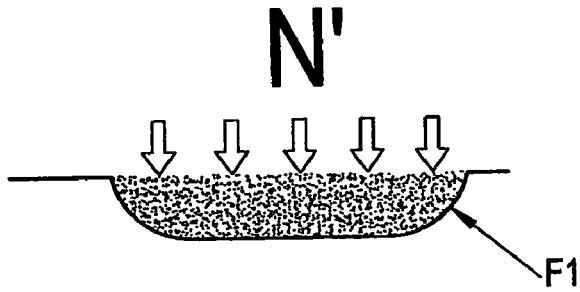

FIG. 21 illustrates the action of a flat tamping punch (N'), which is such as to level out the dose of product in the depression (C) formed in the filter paper (F1) to create an asymmetrical pod.

Figure 22:
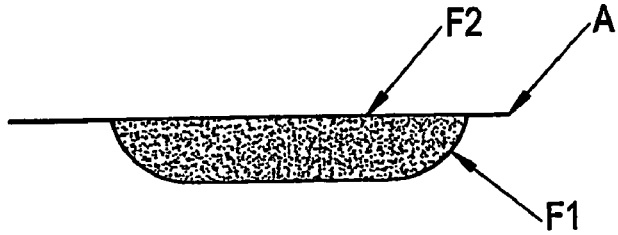

FIG. 22 illustrates the sealing of a compacted asymmetrical pod with a flat filter paper top (F2).

FIGS. 19 BIS, 20 BIS, 21 BIS and 22 BIS are similar to FIG. 19,20, 21 and 22 and represent the action of a concave punch (N'), which is such as to increase the degree of compacting of the same dose of product to create a concave asymmetrical pod.

FIGS. 19 TER, 20 TER, 21 TER and 22 TER represent the action of a concave punch (N), which is such as to increase the degree of compacting of the same dose of product to create a symmetrical pod.

In the figures, the individual details are marked as follows:

A is a flat-topped compacted pod.

B1 is the spool of filter paper (F1).
B2 is the spool of filter paper (F2).
C is the depression formed in the filter paper (F1)
E is a compacted pod of standard shape and size.
F1 is the filter paper to be impressed with the forming punch (M).
F2 is the filter paper for creating the pods.
F3 indicates the overlaying of the two filter papers (F1, F2).
G indicates a recess directly impressed in the flat faces of the prism or the interchangeable dies (S).
L indicates the flat faces of the polygonal prism.
N indicates the tamping punch for the standard type of pods (E).
N' indicates the tamping punch for type (A) compacted pods.
N" indicates the convex tamping punch for type (A) pods.
P is the polygonal prism-shaped carousel.
R indicates the axis around which the carousel rotates intermittently.
t indicates the cuts on the filter paper (F1).
T indicates the flaring of the cuts (t).
W indicates a larger flaring of the cuts (t) to enable the formation of deeper recesses (C).
I, II, III, IV indicate the doses fed for packaging in pods.
1, 2, 3, 4 indicate an orderly sequence of sections where the filter paper will be flat during the pod packaging process.

The figures clearly evidence the compact structural architecture of the packaging machine to which the present invention relates. The invention naturally lends itself to different embodiments as regards both the dimensions and structural proportions of the various parts making up the packaging machine.

It is apparent that the number of sides of polygon may vary, as may the geometric proportions of the prismatic carousel.

It is likewise apparent that the number of recesses (G) and their distribution on the faces (L) of the prism may vary. The choice of cuts (t) will also be adapted to the depth of the depression required.

All the devices that are not illustrated are understood as being made using known systems and actuated with technological components known in the art. Therefore, the scope of the present invention shall encompass all packaging machines featuring the basic, original characteristics described and illustrated herein.

The technological choices that may optimise the functionality of the packaging machine of the present invention are: the number of sides of the polygon, the diameter of the polygonal wheel, the length of each side of the polygon, the width of the prism, the number of recesses (G) and their distribution on the faces of the prism, the distribution and size of the cuts (t), the proportions of the forming and tamping punches (M; N, N', N"), the devices actuating the intermittent rotation of the wheel with a horizontal axis and the filling device for measuring out and dispensing the pre-established doses.

Now that the original innovative characteristics of the present invention have been made apparent, anyone with average skill in the art may construct filter paper pod packaging machines having the basic characteristics as described and illustrated in the following claims.

The invention claimed is:

1. A filter paper pod packaging machine comprising a polygonal prismatic wheel with a horizontal axis for intermittently rotating the wheel, each flat face of the prismatic wheel directly incorporating at least one recess matching a size and shape of pods to be produced, wherein a first web of filter paper, fed from a spool and overlaid by a second web of filter paper fed from another spool is wrapped around the flat faces of the polygonal prismatic wheel, and wherein a series of cuts are made by a cutting device in the first web of filter paper in positions around a central zone corresponding to the at least one recess impressed in the prismatic wheel and wherein a forming punch is applied on the web in the central zone surrounded by the cuts to mold the web to a shape of the at least one recess, said molding of the filter paper being optimized by the presence of cuts which flare out to facilitate the formation of a depression in the filter paper web by action of the forming punch, while a peripheral zone of the filter paper remains flat and adherent to the face of the prismatic wheel.

2. The filter paper pod packaging machine of claim 1, wherein each flat face of the prismatic wheel may be equipped with interchangeable dies having recesses that geometrically match the size and shape of the pods to be produced.

3. The filter paper pod packaging machine of claims 1 or 2, wherein each flat face of the prismatic wheel has a plurality of recesses, either in a radial or axial configuration, in one or more rows.

4. The filter paper pod packaging machine of claim 1, wherein the forming punch creates a recess in the web by flaring the cuts, while a peripheral zone of the filter paper remains flat and adherent to the face of the prism.

5. The filter paper pod packaging machine of claim 1, wherein the depth of the recess allows a pod to hold the same quantity of compacted product as symmetrical pods, the diameter being equal.

6. The filter paper pod packaging machine of claim 1, wherein the recesses feature holes through which suction is applied to attract the filter paper, thereby facilitating moulding of the latter to a shape matching that of the recess during operation of the forming punch.

7. The filter paper pod packaging machine of claim 6, wherein the suction applied through the holes in the recesses remains on even after the forming punch has completed its action in order to assure the adherence of the filter paper to the recesses during subsequent processing.

8. The filter paper pod packaging machine of claim 1, wherein the depression, obtained by the action of the forming punch on the filter paper, is filled with a pre-measured volume of product that will be compacted by means of a specific concave tamping punch for producing symmetrical pods.

9. The filter paper pod packaging machine of claim 1, wherein the depression, obtained by the action of the forming punch on the filter paper, is filled with a pre-measured volume of product that will be compacted by means of a specific flat tamping punch for producing asymmetrical pods and be subsequently sealed with a flat top made from filter paper (F2) fixed onto the pod along edges adherent to the faces of the polygon prismatic wheel.

* * * * *